United States Patent [19]

Holler

[11] Patent Number: 4,677,707

[45] Date of Patent: Jul. 7, 1987

[54] ADJUSTABLE UNITARY HINGE

[75] Inventor: James M. Holler, Jamestown, N.Y.

[73] Assignee: Bush Industries, Inc., Jamestown, N.Y.

[21] Appl. No.: 884,495

[22] Filed: Jul. 11, 1986

Related U.S. Application Data

[63] Continuation of Ser. No. 659,325, Oct. 10, 1984, abandoned.

[51] Int. Cl.[4] ..... E05D 5/10

[52] U.S. Cl. ..... 16/239; 16/380; 16/385; 16/386

[58] Field of Search ..... 16/238, 239, 240, 241, 16/242, 366, 378, 379, 380, 385, 386

[56] References Cited

U.S. PATENT DOCUMENTS

| | | | |
|---|---|---|---|
| 1,044,055 | 11/1912 | Johnson et al. | 49/388 X |
| 1,336,174 | 4/1920 | Way | 16/242 |
| 2,923,555 | 2/1960 | Kost et al. | 280/661 X |
| 3,313,064 | 4/1967 | Kirby | 49/388 |
| 3,580,988 | 5/1971 | Orlowski | 16/2 X |
| 3,613,150 | 10/1971 | Osborn | 16/134 |
| 4,106,158 | 8/1978 | Kellems et al. | 16/242 X |
| 4,106,876 | 8/1978 | Tregoning | 403/4 |
| 4,117,890 | 10/1978 | Youngers | 403/4 X |
| 4,232,880 | 11/1980 | Dickerson et al. | 280/661 |
| 4,412,708 | 11/1983 | Palka | 312/138 |

FOREIGN PATENT DOCUMENTS

| | | | |
|---|---|---|---|
| 1459105 | 7/1969 | Fed. Rep. of Germany | 16/386 |
| 316107 | 11/1956 | Switzerland | 16/242 |

*Primary Examiner*—Fred Silverberg

*Attorney, Agent, or Firm*—Webb, Burden, Robinson & Webb

[57] ABSTRACT

An adjustable unitary hinge including a first shaft having a central longitudinal axis, a second shaft having a central longitudinal axis and an intermediate portion connected to an end of each shaft. The central longitudinal axis of the first shaft is parallel to the central longitudinal axis of the second shaft and is laterally offset therefrom.

2 Claims, 5 Drawing Figures

ADJUSTABLE UNITARY HINGE

This application is a continuation of application Ser. No. 659,325, filed Oct. 10, 1984 now abandoned.

BACKGROUND OF THE INVENTION

1. Field of the Invention

This invention relates to a hinge for pivotally joining two members such as a door in a frame, between shelves or the like and particularly to an adjustable unitary hinge which is suitable for adjustably mounting a door in a cabinet frame, such as in KD furniture or the like. The hinge is preferably made of plastic material, such as polyethylene, but is may be made from any suitable material such as plastic or metal.

2. Brief Description of the Prior Art

Hinges are the most common and convenient means for pivotally mounting one member to another so that one member, such as a door, can be swung with respect to the other. Such hinges commonly take the form of brackets which are secured to the members and are joined by a pintle journaled in the brackets, such as the hinges on a door and associated door frame.

Similarly, hinges have been long used on doors for furniture such as cabinets wherein the door and cabinet frame are joined by a hinge which includes at least a pair of brackets, one attached to each member joined by a pintle or hinge pin. In some furniture hardware, the brackets are carefully designed for their aesthetic appearance.

With the advent of "KD" or knockdown furniture, that is furniture such as cabinets which are shipped to a consumer in unassembled condition for assembly by the consumer, it has become standard practice for the manufacturer to prefabricate most or all holes in the furniture members so that the customer must merely align the frame members and, using simple tools, such as a screwdriver, assemble the furniture. The assembly is completed using are packaged hardware such as hinges, pulls and wood or machine screws.

In the case of KD furniture such as cabinets with doors, a customer is required to properly align and fit cabinet doors in the cabinet frame using prepackaged hinges. Where the holes for the hinges have been preformed or predrilled, it is sometimes difficult for the customer to install the door hinges in the frame using the predrilled holes such that the door swings properly in the frame and properly closes neatly and tightly without damaging the cabinet frame or the hinges. In the worst cases where the proper door fit is impossible to obtain, the customer may be required to fill the predrilled holes with a cabinet filling compound, such as putty or epoxy resin, and redrill the holes in the frame and/or door to achieve the proper fit and door swing.

The difficulty in aligning a furniture door in a frame properly usually is attributable to the fact that the door cannot be easily horizontally aligned with respect to the frame because the predrilled holes in the furniture are not properly aligned with those in the door. This is particularly true in the case of recently introduced KD furniture, such as cabinets wherein the door is designed to be installed in the frame using hardware which joins the top and bottom edges of the door to the inside top and bottom edges of the cabinet frame, as contrasted with furniture which uses conventional bracket and pintle hardware on the faces or vertical edges of the door and frame.

To overcome the problem of aligning the door with a frame, hardware manufacturers have designed several types of adjustable hinges. For example, U.S. Pat. No. 3,313,064 discloses an adjustable hinge which provides independent vertical and horizontal adjustment of the door on the frame. The hinge is complex and requires separate adjustments in order to achieve vertical and horizontal adjustment.

Another form of complex adjustable hinge is disclosed in U.S. Pat. No. 3,613,150. This hinge is basically the bracket and pintle type hinge, except that the bracket journals are threaded to cooperate with threaded bushings on the hinge for vertical adjustment. The bore of the bushing is eccentrically drilled relative to the bushing diameter so that when the bushing is turned over the pintle, a degree of horizontal adjustment is obtained. Alternatively or additionally, the pin may be mounted eccentrically to obtain horizontal adjustment of a door mounted on the hinge.

A third form of adjustable hinge which is also complex in that it contains a plurality of parts is described in U.S. Pat. No. 4,412,708. That hinge is particularly designed for cabinets but attaches to the cabinet side wall.

Each of these hinges consists of a plurality of separate elements and requires individual adjustments which take time and at least some mechanical ability.

SUMMARY OF THE INVENTION

The present invention is an adjustable unitary hinge. The hinge which is preferably integrally formed in one piece, comprises a first shaft for insertion in a hole in a frame, such as a furniture cabinet frame; a second shaft for insertion in a hole in the edge of a door, e.g. for a furniture cabinet; the central longitudinal axes of said first and second shafts being parallel to and laterally offset from one another and means intermediate and attached to said shafts for rotating said shafts about their respective central axes.

The hinge pin is preferably formed by molding the shafts and rotating means from plastic material, such as polyethylene, such that the base of each shaft forms a part of the rotating means and each shaft extends outwardly therefrom.

The rotating means preferably is in the form of a nut having a plurality of flats, such as a hexagonal or octagonal nut, which may be grasped and the nut turned using a conventional tool, such as a wrench. In the preferred embodiment, the axis of one shaft is concentric with the axis of the nut and the axis of the other shaft is eccentric thereto.

Preferably an index mark, such as a locator dot, is placed on a top surface of the nut to identify the initial position of the hinge with respect to the cabinet frame and door in which the hinge is to be used.

Means for retaining a shaft in a hole of a cabinet frame, shelf or the like may be provided on the surface of one shaft. For example, one or a plurality of spaced ridges or ribs may be provided on the circumference of a shaft for frictionally engaging the hole in a cabinet frame and/or door. Alternatively, other devices may be provided on one or both shafts for engaging a hole in a cabinet frame or door provided that the hinge is permitted to rotate at least 90° to permit horizontal alignment of a door with respect to a frame or shelving.

The hinge may be made of plastic material such as polyethylene, polypropylene or the like so long as it has the required material strength, or of metal, such as steel or the like. Preferably, it is polyethylene since the nut of the lower pin on a door serves as a guide or bearing surface or washer permitting free, smooth rotation of the door in the cabinet frame. The material should be selected consistent with the nature of the intended use and the relative cost. In addition, the hinge may be made of any convenient and suitable size.

One presently preferred adjustable hinge, according to the invention, is injection molded of a black polyethylene material. The hinge is approximately one inch (1") in total length. The first shaft which is designed to be introduced into a predrilled hole in the frame is about ⅜" long and the second shaft is ½" long. Each shaft is about ¼" in diameter. The central axes of the shafts are offset laterally about 1/24". The maximum width of the nut, from flat to opposite flat is ½". The axis of the second shaft is concentric with the axis of the nut and the axis of the first shaft is eccentric thereto.

A complete understanding of the invention will become apparent from the following description when taken with the accompanying drawings.

DETAILED DESCRIPTION OF PRESENTLY PREFERRED EMBODIMENTS OF THE INVENTION

Figure 1:
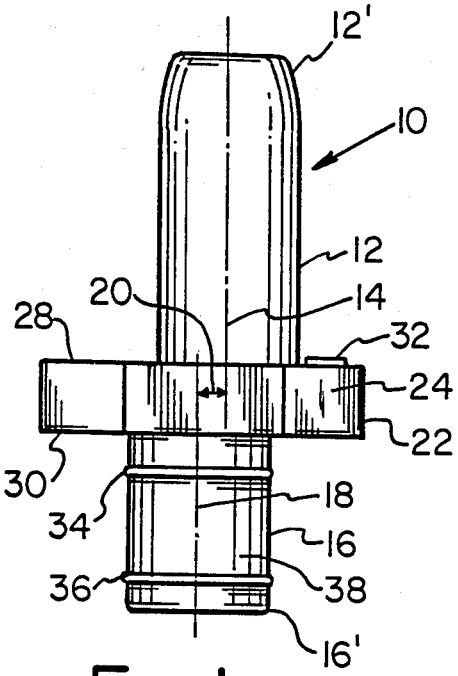
FIG. 1 is a side elevational view of an adjustable hinge in accordance with the invention.
Figure 3:
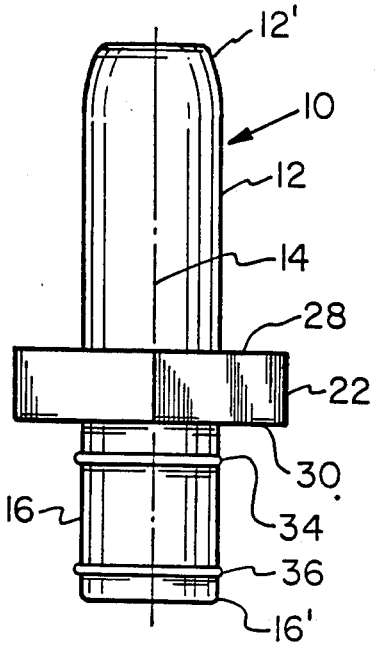
FIG. 3 is a side elevational view of the hinge of FIG. 2 taken at 90° to the showing of FIG. 1.
Figure 2:
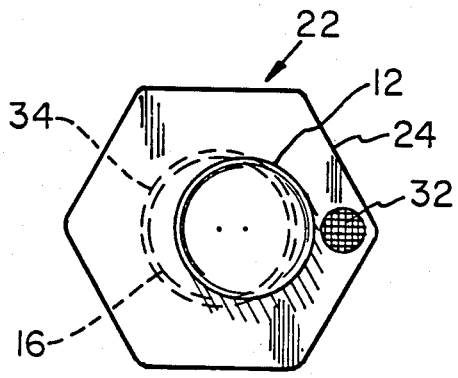
FIG. 2 is a top plan view of the hinge of FIG. 1.

Referring to the invention as illustrated in FIGS. 1–3, the adjustable hinge 10, according to the invention, is preferably integrally formed in one piece. The hinge 10 includes a first shaft 12 having a central axis 14 and a second shaft 16 having a central axis 18. The axes 14 and 18 are laterally offset from one another by a distance 20. The distal end of the first shaft is smoothly tapered at 12' and the distal end of the second shaft is slightly rounded at 16' to facilitate entry of the shafts into holes in a frame of a cabinet, shelves and the like. Intermediate the two shafts 12, 16 is a means for rotating the shafts, preferably in the form of a nut 22 of hexagonal form including flats 24 for engagement by a tool, such as a wrench 26 (See FIG. 4). As shown, the central axis of the nut is coincident with the central axis 18 of the second shaft 16. The nut also includes a top surface 28 and a bottom surface 30. Preferably a mark, such as a raised locator dot 32, is provided on surface 28 to identify the position of the hinge 10 when it is installed. One or more ridges or ribs 34, 36 may be provided on the outer surface 38 of the second shaft 16 which is adapted to be frictionally inserted in a predrilled hole in a furniture cabinet frame or the like. The purpose of the ridges or ribs on second shaft 16 is to prevent the hinge 10 from rotating in the predrilled hole as a door mounted on the hinge is rotated to an open position. The surface of the first shaft 12 is smooth to permit such rotation. Of course, other devices may be employed on the perimeter surface of the second shaft 16 in order to obtain a tight frictional fit of the shaft in a predrilled hole.

Figure 4:
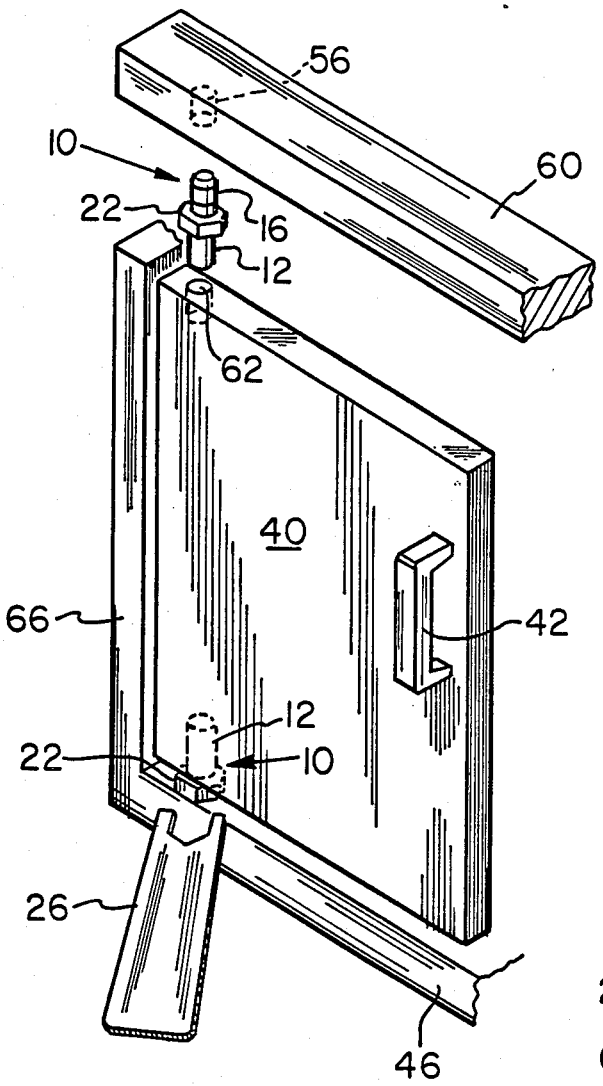
FIG. 4 is a perspective view showing a pair of hinges in position with a cabinet frame and door.
Figure 5:
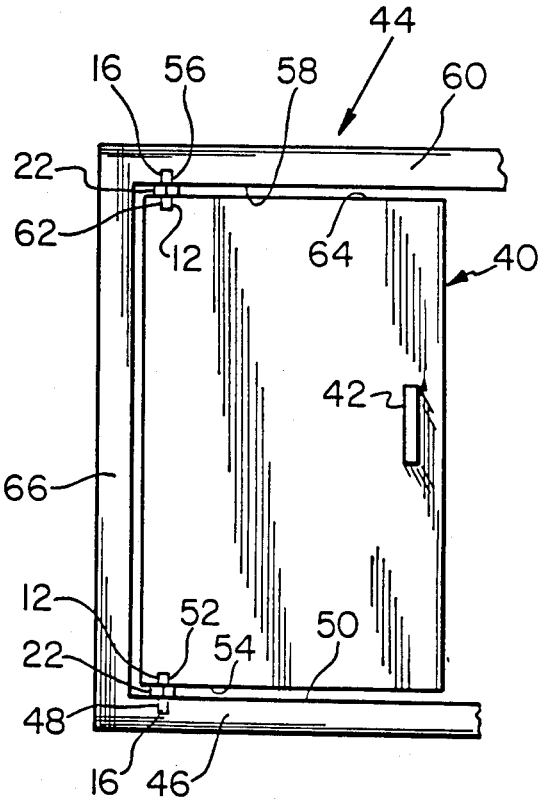
FIG. 5 is a partial front view of a cabinet frame and door showing a pair of hinges.

The hinge 10 in accordance with the invention is particularly useful for rotatably joining a door 40 having a handle 42 to a frame 44 of a KD furniture cabinet shown in FIGS. 4 and 5. One hinge 10 is installed in bottom rail 46 of the frame by inserting the second shaft 16 of the hinge in predrilled hole 48 in the top edge 50 of the rail 46. The door 40, which also has a predrilled hole 52 in its lower edge 54, is then placed in the frame 44 such that the first shaft of the hinge enters the hole 52. Next, a second hinge 10 is placed with the second shaft 16 of the hinge 10 being introduced into predrilled hole 56 in the bottom edge 58 of a top frame rail 60 and then top frame rail 60 with hinge 10 is placed over the door 40 such that the downwardly extending first shaft 12 of hinge 10 extends into a predrilled hole 62 in top edge 64 of the door 40. When originally installed, each hinge 10 has its locator dot 30 aligned with the plane of the door 40. Alternatively, the second shaft 16 of each hinge 10 can be inserted into the respective top and bottom edges of the door 40 and the first shaft inserted into the respective top and bottom frame rails of the cabinet.

If the holes in the door and frame are not in alignment, it will be difficult if not impossible to insert a hinge 10 in the predrilled holes in the frame and/or door and, of course, the door will not swing freely in the frame opening formed by the top and bottom rails and side rail 66 of frame 44 as it is designed to do. Any slight misalignment between the door and the frame, however, can be compensated by adjusting the hinges pins 10 to move the door horizontally and properly align it with respect to the frame 44. This adjustment is accomplished by rotating each hinge, as required, by applying a tool, such as wrench 26, to the nut of the hinge and rotating the nut and thereby the hinge until the door 40 is aligned precisely in the frame opening. Of course, any suitable tool can be used to rotate the hinge provided it is no wider than the thickness of the nut 40.

When installed, the door 40 swings easily on the hinges. This is particularly enhanced by making the hinges of polyethylene, since the lower edge of the door rests upon and is guided by the nut 22 of the lower hinge which provides a bearing top surface 28 for the lower edge 54 of the door providing smooth rotation of the door in the frame 44.

Although only one door 40 is pivoted along the left-hand side of the frame as shown in FIGS. 4 and 5, it is evident that the same hinge can be used to mount a door on the right-hand side of a cabinet frame and/or that hinges according to the invention can be used to mount properly a pair of doors, such as a matched set of doors, one of the left and one on the right side of a single cabinet frame.

The present invention has been described with respect to a conventional cabinet having a horizontally swinging door or doors. It is equally useful in a cabinet having a "drop door," that is a door which is pivoted from the side rails or element of a cabinet frame near the top of the frame opening or in a cabinet having a "fold up door," that is a door which is pivoted from the side rails or elements of a cabinet frame near the bottom of the frame opening. It will be apparent to persons of ordinary skill in the art that a drop door or fold up door is substantially illustrated by rotating the drawing of FIG. 5 clockwise 90° or counterclockwise 90°, respectively.

Moreover, it will be apparent to one of ordinary skill that the hinges according to the invention can be used to join any two members in precise alignment for rotation of one member with respect to another, not only doors and frames. For example, a window or mirror could be substituted for the door of FIGS. 4 and 5 and, so long as holes are provided in the edges of the window or mirror frame, the hinges 10 could be used. Similarly, the so-called "frame" of the cabinet could be the edges of shelves on the top and/or bottom of the cabinet.

The hinges 10 are preferably injection molded from polyethylene, but they could be made from other types of plastic materials or from metal. They are inexpensive, easy to install, and easily adjusted. They are especially useful to align elements of KD furniture.

Having described presently preferred embodiments of the invention, it is to be understood that they may be otherwise embodied within the scope of the appended claims.

I claim:

1. In a furniture cabinet having opposed upper and lower frame members and opposed side frame members forming a frame opening for receiving a door and the door having opposed edges within said frame opening and said opposed edges of said door being spaced from said frame members to permit movement of said door relative to said frame members, each of two opposed frame members being formed with an elongated hole with a longitudinal central axis in substantial alignment with the longitudinal central axis of the opposed hole, two opposed edges of said door being formed with an elongated hole having a longitudinal central axis in substantial alignment with the longitudinal central axis of the hole in the opposed edge of said door, the central longitudinal axes of the holes in said frame members and the central longitudinal axes of the holes in the opposed edges of said door being in substantial alignment when said door is positioned within said frame opening, the improvement comprising a rotatable one piece hinge pivotally connecting said door to the two opposed frame members, said rotatable one piece hinge having:

(a) a first substantially cylindrical solid shaft having a central longitudinal axis and an uninterrupted outer surface and adapted to fit into the elongated hole in the opposed edge of said door;

(b) a second substantially cylindrical solid shaft having a central longitudinal axis and adapted to fit into the elongated hole in the frame member;

(c) a plurality of rigid circumferential ribs on the exterior surface of said second shaft to create a friction fit between said second shaft and said elongated hole in said frame member;

(d) a solid intermediate portion located between said first shaft and said second shaft and integral with one end of each of said shafts and the exterior edge of said intermediate portion having an exterior edge parallel to the central longitudinal axes of said shafts and said exterior edge extending at all points around its circumference outwardly beyond the exterior cylindrical surface of said first shaft and the exterior cylindrical surface of said second shaft;

(e) said intermediate portion being located between the frame member and the edge of said door and said exterior edge of said intermediate portion being formed with a plurality of flats for access by a wrench at all points around the periphery of said exterior edge to rotate said intermediate portion and said shafts to adjust the lateral position of said one piece hinge;

(f) the central longitudinal axis of said intermediate portion being aligned with the central longitudinal axis of said second shaft and the central longitudinal axis of said first shaft being laterally offset from the central longitudinal axes of said intermediate portion and said second shaft; and (g) a visual locater mark on a surface of said intermediate portion to position said one piece hinge relative to said frame members and a juxtaposed edge of the door located within said frame opening formed by said frame members;

(h) whereby rotation of said intermediate portion of said one piece hinge by the wrench rotates said first and second shafts about their respective central longitudinal axes to laterally adjust the position of said door relative to said frame members.

2. An adjustable one piece hinge as set forth in claim 1 which is made of a polyethylene material.

* * * * *